US005349367A

United States Patent [19]

Wakita

[11] Patent Number: 5,349,367

[45] Date of Patent: Sep. 20, 1994

[54] DRIVING CIRCUIT FOR USE IN A LIQUID CRYSTAL DISPLAY DEVICE

[75] Inventor: Naohide Wakita, Osaka, Japan

[73] Assignee: Matsushita Electric Industrial Co., Ltd., Osaka, Japan

[21] Appl. No.: 9,850

[22] Filed: Jan. 27, 1993

[30] Foreign Application Priority Data

Jan. 27, 1992 [JP] Japan ..... 4-011658

[51] Int. Cl.[5] ..... G09G 3/36

[52] U.S. Cl. ..... 345/97; 345/89

[58] Field of Search ..... 340/784, 793, 812; 348/87, 89, 97, 94

[56] References Cited

U.S. PATENT DOCUMENTS 4,367,924 1/1983 Clark et al. ..... 359/56
4,709,995 12/1987 Kuribayashi et al. ..... 359/56
4,840,462 6/1989 Hartmann ..... 359/56
4,981,340 1/1991 Kurematsu et al. ..... 359/56
5,061,044 10/1991 Matsunaga ..... 359/75

FOREIGN PATENT DOCUMENTS 0466506 1/1992 European Pat. Off. .
6066235 4/1985 Japan .

*Primary Examiner*—Alvin E. Oberley
*Assistant Examiner*—Minsun Oh
*Attorney, Agent, or Firm*—Ratner & Prestia

[57] ABSTRACT

In a ferroelectric liquid crystal panel, the switching current of spontaneous polarization is detected from the difference between the current supplied to a selected pixel and the constant multiplication of the current supplied to a non-selected reference pixel, and when the amount of switched spontaneous polarization reaches a desired gray scale level, the applied voltage is changed so that even if any nonuniformity is involved within the panel, a uniform analog gray scale display can be realized.

7 Claims, 6 Drawing Sheets

DRIVING CIRCUIT FOR USE IN A LIQUID CRYSTAL DISPLAY DEVICE

BACKGROUND OF THE INVENTION

Field of the Invention

The present invention relates to a driving circuit for use in a ferroelectric liquid crystal display device using ferroelectric liquid crystals, in particular, to a ferroelectric liquid crystal display device capable of gray scale display of uniform analog tones even when a large display area is involved in a liquid crystal panel.

Description of the Prior Art

Ferroelectric liquid crystals will form a layer structure and have spontaneous polarization orthogonally crossing the molecular long-axes of the liquid crystals. If the spiral structure of the liquid crystal cell layer is unwound by thinning the thickness of the layer, the molecules of the liquid crystals interact with substrates, exhibiting a bistability. Also, their spontaneous polarization interacts with an electric field applied thereto, giving an extremely high response speed. Further, exhibiting a rapid non-linear response, the ferroelectric liquid crystals are suitably available for high contrast display without adding active elements, allowing a high quality display with low cost. Such a high contrast display with ferroelectric liquid crystals is described in detail in the U.S. Pat. No. 4,367,924.

Ferroelectric liquid crystal panels, although of bi-level display in black and white microscopically, involve mixtures of black and white state during a process of switching from black to white, thus being capable in principle of half-tone or gray scale display. In the simple matrix driving without using any active element, a conventional driving waveform for gray scale display is disclosed, for example, in the U.S. Pat. No. 5,061,044. It is described in this document that the prior-art example may be arranged to provide a gray scale display by applying a signal voltage having an intermediate voltage level between ON and OFF levels for gray scale display.

A conventional driving circuit for ferroelectric liquid crystal device is disclosed, for example, in the U.S. Pat. No. 4,709,995. The driving circuit comprises a row drive unit for applying a scanning signal and a column drive unit for generating a signal voltage. The signal voltage is determined in value according to contents of a frame memory for each pixel data.

However, the method as disclosed in the U.S. Pat. No. 5,061,044 has difficulty in providing a gray scale display of uniform tones if a threshold voltage fluctuates because of nonuniformity in thickness of the panel. Since the orientation of the ferroelectric liquid crystals is switched depending on the interaction between the electric field and the spontaneous polarization of the ferroelectric liquid crystals, the threshold voltage tends to vary due to the variation of the thickness of the liquid crystal cell layer.

Further, since the ferroelectric liquid crystal cell layer is small in thickness as thin as 2 μm or so and moreover has spontaneous polarization, electric capacity of the liquid crystal layer is Greater than that of STN, causing a so-called electrode decay to be likely to occur, i.e. a phenomenon that the waveform becomes less sharp around the tips of electrodes. The threshold voltage will vary also depending on temperature.

These reasons account for the tendency that the nonuniformity within the liquid crystal panel will easily occur.

Conventional driving circuits were arranged to produce an intermediate voltage according to video data. However, since the nonuniformity of thickness within the panel that may actually be involved is not compensated, a uniform Gray scale display cannot be achieved. In particular, the matrix driving method is required to have a rapid threshold characteristic, and therefore the number of Gray scale levels or tones to be displayed is limited to small one.

In the U.S. Pat. No. 4,840,462, disclosed is an arrangement of a ferroelectric liquid crystal display in which the amount of charges to be supplied is varied depending on gray scale data with the voltage for driving the active element. Another example as disclosed in the Japanese Patent Laid-Open (Unexamined) Publication SHO 60-66235 is such that the voltage is controlled while the amount of polarized charges is detected, thus attempting to obtain uniform gray scale display.

Both of the U.S. Pat. No. 4,840,462 and the Japanese Patent Laid-Open SHO 60-66235 have suggested methods for solving the above-mentioned problems by controlling the amount of polarized charges of liquid crystals. However, the amount of polarized charges was measured as the sum of the polarization of charges such as electrons and ionic impurities due to the dielectric component and the spontaneous polarization of the ferroelectric liquid crystals. The capacity by the dielectric component is affected by the nonuniformity of the thickness of the cell layer within the liquid crystal panel, while the concentration of ionic impurities would be made nonuniform by injection process of liquid crystals or the like.

For this reason, the conventional methods, which are not arranged to measure only the amount of spontaneous polarization, cannot exclude the effect of the nonuniformity within the panel, so that uniform gray scale display cannot be offered. Also, either of the U.S. Pat. No. 4,840,462 or the Japanese Patent Laid-Open SHO 60-66235 has no description upon some methods for driving a liquid crystal device by a simple matrix driving manner.

Ferroelectric liquid crystals, although exhibiting bistability, are brought into gray scale display state during the process of transition of switching between black and white display conditions. Nonetheless, the ferroelectric liquid crystal device has difficulties in achieving gray scale display of continuous tones, which is mainly ascribed to nonuniformity in threshold characteristics among sites within the liquid crystal panel. Accordingly, whether or not the gray scale display of continuous tones can be realized with ferroelectric liquid crystals depends on how such nonuniformity in threshold characteristics can be corrected.

The U.S. Pat. No. 4,840,462 and the Japanese Patent Laid-Open SHO 60-66235 disclose methods of controlling the amount of polarized charges of a liquid crystal device, whereas the amount of polarized charges is an index which involves the nonuniformity of the liquid crystal panel. Therefore, the conventional methods cannot sufficiently compensate the nonuniformity within the panel. In those methods, pulse voltage is used for driving a liquid crystal panel, where, at the first step, a current for charging the capacity component according to the dielectric constant of liquid crystals flows in a large amount, thereby causing a voltage to be applied to the liquid crystal layer, and then switching of spontaneous polarization of liquid crystal molecules will start with some delay.

Charge Q1 due to the dielectric component can be derived according to the following equation:

$$Q1 = CV = \epsilon_{LC}\epsilon_O SV/d, \quad (1)$$

where if the relative dielectric constant of liquid crystals $\epsilon_{LC}=7$, area $S=1$ cm$^2$, thickness $d=1.8$ μm, $\epsilon_O=8.854\times10^{-12}$ F/m, voltage $V=25$ volts, then the resulting $Q1=86$ nC.

On the other hand, if molecules of the ferroelectric liquid crystals are switched in direction (i.e., display is switched between black and white), the spontaneous polarization is switched, causing a Ps switching current to flow. Once a pixel that has been reset into a black state with a one-polarity pulse has an opposite-polarity pulse applied thereto, the molecules will start being switched into a white state. At this time, the spontaneous polarization is switched from −Ps to +Ps, so that the amount of accumulated charges that flow will be the product of the doubled Ps and the switched area.

Charge Q2 due to the ferroelectric component is represented by the product of the amount of spontaneous polarization Ps per unit area of liquid crystals and the pixel area:

$$Q2 = 2Ps \cdot S \quad (2)$$

where if the spontaneous polarization Ps is assumed to be 20 nC/cm$^2$, Q2 will be 40 nC. Assuming here that the thickness d has a nonuniformity of ±0.1 μm in equation Q1, the error of Q1 becomes approximately 9.5 nC, which is generally equal to ¼ of Q2. Q2 reflects the density of the pixel accurately, however, even if the polarized charge of the sum of Q2 and Q1 is controlled, only a slight nonuniformity in thickness as small as ±0.1 μm will make it difficult to provide a uniform gray scale display of continuous tones.

Further, the threshold characteristic by which the spontaneous polarization is switched will be varied depending on the orientation of liquid crystal molecules and ionic impurities, which leads to variance in response characteristic of molecules (spontaneous polarization) due to any nonuniformity in a rubbing orientation treatment or injection process of liquid crystals.

In consequence, the conventional methods cannot be free from any influence of the nonuniformity within the panel.

SUMMARY OF THE INVENTION

Accordingly, an essential object of the present invention is to realize a gray scale display of continuous tones even with a large area of a liquid crystal panel by allowing gray scale level to be uniformly displayed within the panel even if a ferroelectric liquid crystal panel has some nonuniformity in its thickness or amount of charges within the panel.

In order to achieve the aforementioned object, the present invention provides a driving circuit for a liquid crystal panel in which ferroelectric liquid crystals are sandwiched between scanning electrodes and signal electrodes, which are opposed to each other, the driving circuit comprising:

a switching current detecting section for detecting a switching current due to switching of spontaneous polarization of the ferroelectric liquid crystals at a selected pixel on a signal electrode a depending on a current value supplied from an arbitrary signal electrode a; an integrating section for integrating the value of the switching current; and a comparator for comparing the integrated value with a gray scale indicating voltage corresponding to gray scale data, wherein the gray scale indicating voltage and the integrated value are made coincident with each other by changing the value of a signal voltage applied to the signal electrode a depending on an output of the comparator, so that the gray scale data and the actual gray scale level of a pixel can be made completely coincident with each other, thus allowing to perform gray scale display of uniform and continuous tones. In particular, the switching current detecting section is able to detect the switching current of the spontaneous polarization accurately by subtracting a current value derived from multiplying by a constant the current supplied to a signal electrode or scanning electrode that forms a non-selected pixel j in the vicinity of a selected pixel on an arbitrary signal electrode a, from the current supplied to the arbitrary signal electrode, so that the uniform gray scale display of continuous-tones can be offered.

With the above arrangement, even if there is any nonuniformity of threshold value within the panel, the switching of spontaneous polarization will be stopped if the applied voltage is reduced when or immediately before accumulated charge Q of the switching current has reached a value corresponding to a desired pixel density, thus making it possible to provide a desired gray scale display. If there is provided a circuit for this purpose, which circuit converts the accumulated charge Q into a voltage Vq, compares the converted voltage Vq with a gray scale indicating voltage Vg which corresponds to the gray scale level of video data by a comparator, and feeds back its output to a selector switch of applied voltage, then any desired gray scale display can be obtained by virtue of a high response speed of the comparator enough larger than that of liquid crystals.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

The following describes a preferred embodiment of a ferroelectric liquid crystal display having a driving circuit for a ferroelectric liquid crystal device according to the present invention with reference to the drawings.

In the preferred embodiment, only charges due to switching of spontaneous polarization which accurately corresponds to gray scale levels are to be detected and controlled.

With regard to the above-mentioned equations (1) and (2), at a starting process of switching of spontaneous polarization by applying a pulse to a pixel, if the application of voltage is reduced when or immediately before the integrated value Q2 of Ps switching current reaches a destination value corresponding to a desired pixel density, the switching of the spontaneous polarization will be stopped, making it possible to provide a desired gray scale display of continuous tones. If there is provided a driving circuit for this purpose, which circuit converts the accumulated charge Q2 into a voltage Vq which is compared by a comparator with a gray scale indicating voltage Vg corresponding to the gray scale level of video data, and feeds back the binary output of the comparator to a selector switch for switching the application voltage, thereby obtaining any desired gray scale display by virtue of the response speed of the comparator enough higher than that of the liquid crystals.

In order to detect the Ps switching current for switching spontaneous polarization, it is necessary to separate the charge up current to the dielectric component, d.c. current component due to movement of ionic impurities, and the like from the supply current to pixel electrodes. Therefore, in the present invention, with pixels in the vicinity of a selected pixel regarded as reference pixels, a voltage of such level as not to cause spontaneous polarization to be switched is applied to the reference pixels and the current flowing thereto is multiplied by a constant (multiplied by the applied voltage ratio) and is subtracted from the current to the selected pixel. Thus, it becomes possible to separate only the switching current of Ps even if any nonuniformity is involved with regard to the panel.

Figure 1:
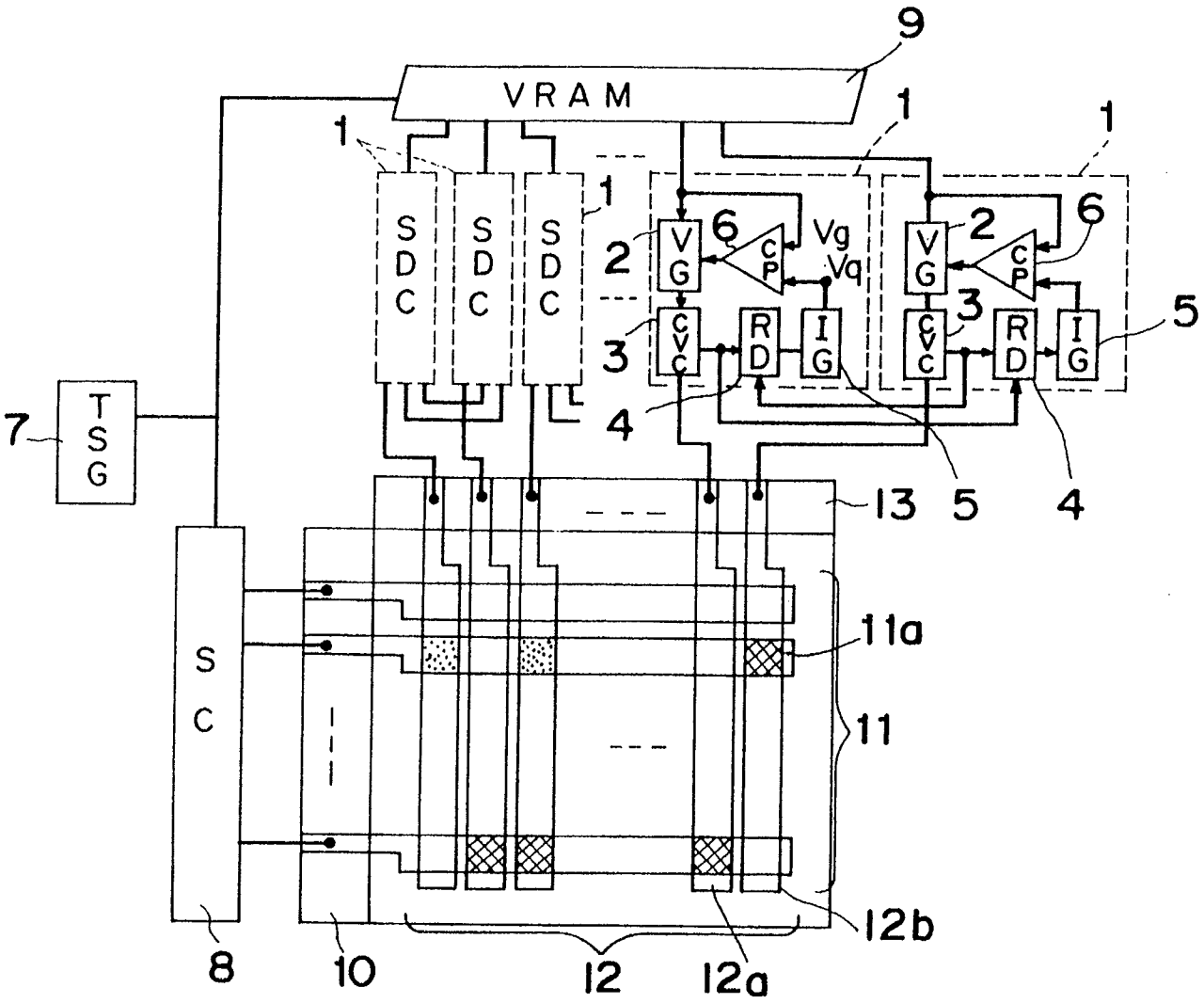
FIG. 1 is a block diagram showing an arrangement of a ferroelectric liquid crystal driving circuit and a display device according to an embodiment of the present invention.

FIG. 1 shows an arrangement of a ferroelectric liquid crystal display with a driving circuit for a ferroelectric liquid crystal device of the present invention.

Figure 2:
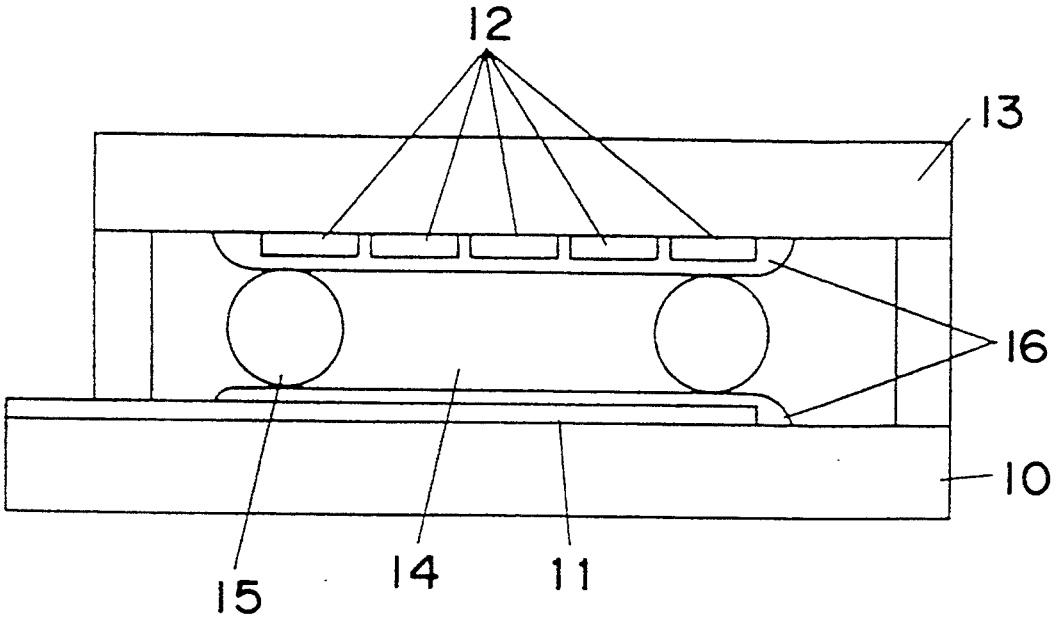
FIG. 2 is a cross sectional view of a liquid crystal panel.

FIG. 2 shows a sectional view of a liquid crystal panel portion of the display device shown in FIG. 1.

Referring to FIGS. 1 and 2, the ferroelectric liquid crystal display comprises a plurality of signal electrode drive circuits (SDC) 1 interposed between a liquid crystal panel and a video memory (V-RAM) 9. The liquid crystal panel includes scanning electrodes 11 and signal electrodes 12 formed on a pair of glass substrates 10 and 13 respectively, and ferroelectric liquid crystal layer 14 sandwiched between the scanning electrodes 11 and the signal electrodes 12. The thickness of the liquid crystal layer 14 is adjusted to approximately 1.8 μm by providing spacers 15. Covering over the scanning and signal electrodes 11 and 12 respectively, there are formed a pair of rubbing alignment treated films 16 to uniformly orient the alignment of the ferroelectric liquid crystal molecules.

In synchronization with clock signals generated by a timing signal generator (TSG) 7, the scanning electrodes 11 are successively scanned by means of a scanning circuit (SC) 8. The video memory (V-RAM) 9 outputs a gray scale indicating voltage corresponding to a selected pixel, which is applied to a voltage generator (VG) 2 provided in each of the corresponding signal electrode drive circuit (SDC) 1. The voltage generator (VG) 2 outputs a select voltage.

Figure 3:
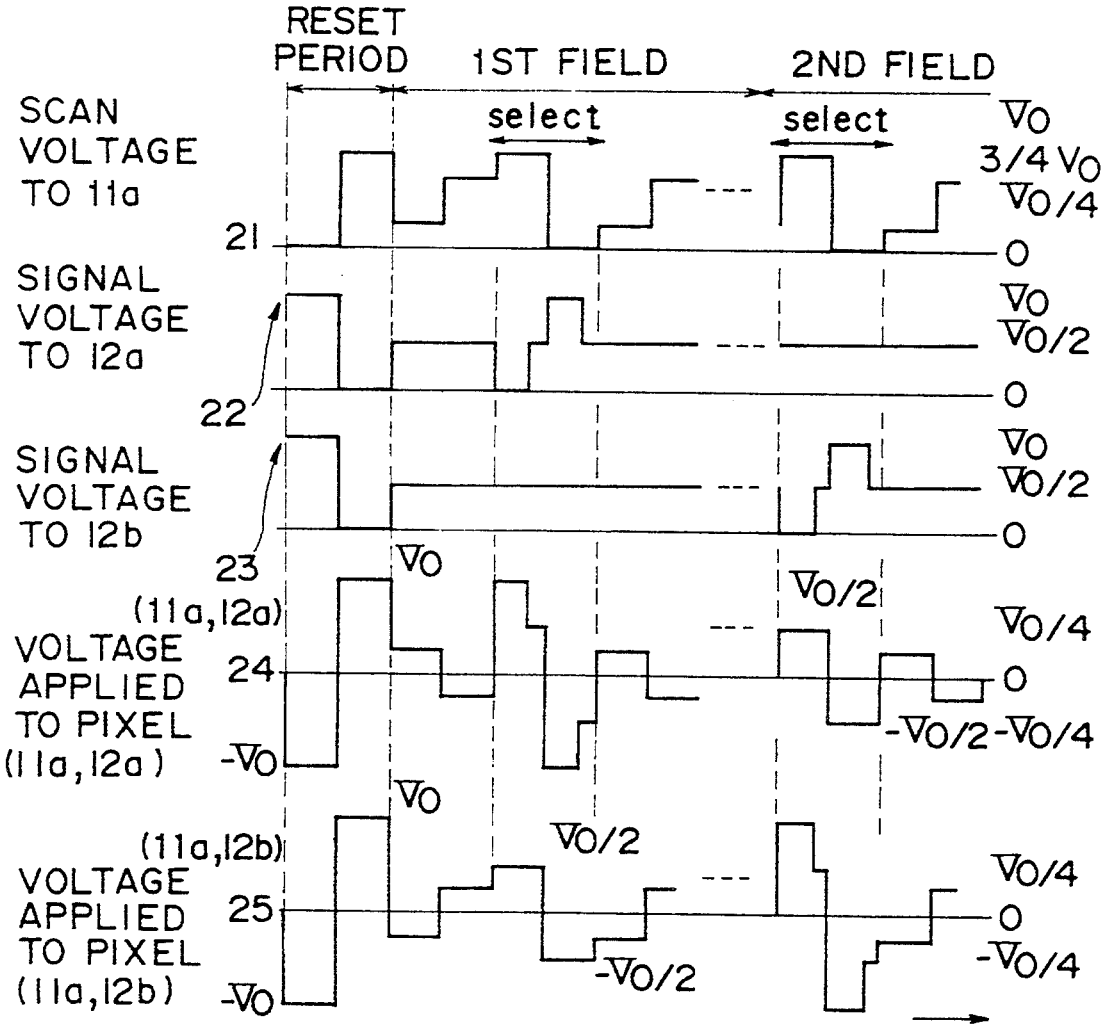
FIG. 3 is a driving waveform diagram according to the embodiment of the invention.

FIG. 3 shows driving waveforms of the select voltage generated by the voltage generator 2, where the waveforms are derived from the voltage selection method with $\frac{1}{4}$ bias. An output current of the voltage generator 2 (VG) is detected by a current-voltage converter 3 (CVC).

Figure 5:
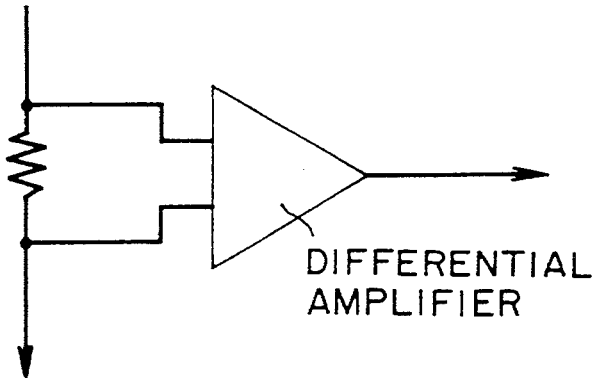
FIG. 5 is a circuit diagram of a current-voltage converter according to the embodiment of the invention.

FIG. 5 shows a circuit arrangement of the current-voltage converter 3. The output current value converted into voltage is fed to a switching current detector 4 (RD).

Figure 6:
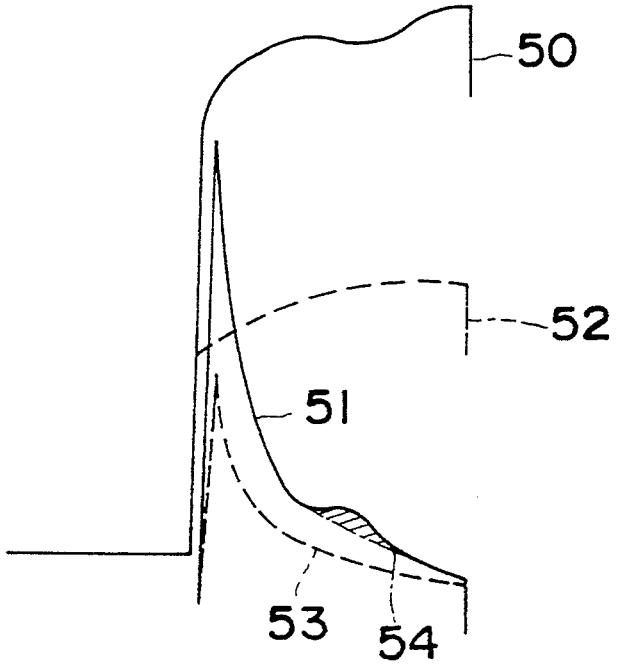
FIG. 6 is a view showing the curve of output voltage and current applied to signal electrodes according to the embodiment of the invention.

FIG. 6 shows a relation between a signal voltage and an output current value that occurs when a scanning electrode 11*a* and a signal electrode 12*a* have been selected. The output current value will be as indicated by a curve 51 with respect to a select voltage 50 to be applied to the signal electrode 12*a*, the output current value 51 having such a shape that the Ps switching current of the selected pixel has been added to the charge up current to the capacity due to the dielectric component of the liquid crystals.

The output current value of the convertor 3 will be resulting as indicated by a broken line 53 when a non-select voltage (designated by a broken line 52) is applied to an adjacent signal electrode 12*b* which is regarded as a reference electrode, having a waveform consisting of only the charge up current. If the output current 53 corresponding to the reference electrode 12*b* is doubled (multiplied by a ratio of select voltage to non-select voltage), it will be as indicated by a dash-and-dot line 54, forming the charge up current component to the selected electrode 12*a*, while the difference between a solid line 51 and the dash-and-dot line 54 will be the hatched portion, which can be detected as the added Ps switching current.

Although FIG. 6 illustrates only one polarity, it is noted here that the threshold voltage is approximately equal whether positive or negative, so that the case will be the same with the applied voltage of the reverse polarity.

Since there is a considerable difference between the peak of the charge up current and the height of the switching current, a suppressed rising edge of the charge up current would result in a less error. Therefore, the output current is preferably passed through a high frequency cut filter before comparing between the two current values.

Figure 7:
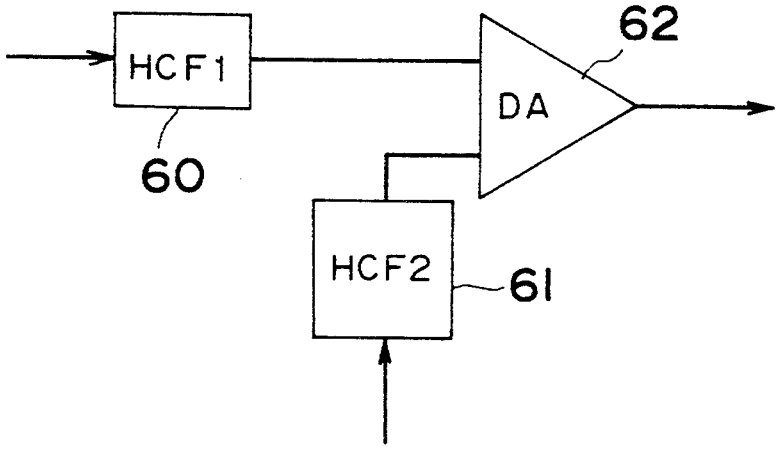
FIG. 7 is a block diagram showing an arrangement of a switching current detector according to the embodiment of the invention.

The switching current detector 4 (RD) is as shown in FIG. 7. The output currents of the selected signal electrode 12*a* and reference signal electrode 12*b* are respectively passed through high frequency cut filters 60 (HCF1) and 61 (HCF2), and subtracted therebetween by a differential amplifier 62 to given an output. In this treatment, the multiplying factor for the low frequency band of the filter 61 is 2.

The resultant output of the detector 4 is integrated by an integrator (IG) 5 and normalized to an appropriate multiplying factor to adjust the scale with the gray scale indicating voltage Vg, yielding an output as a switching charge indicator Vq. The spontaneous polarization is assumed to be 20 nC/cm$^2$ in the present embodiment, and therefore, based on the fact that the double of the amount of the charges multiplied by the area of one pixel is the amount of switching charges that results when the entire pixel has switched from black to white display, which value can be assumed to be 1, the switching charge indicator Vq can be given by multiplying the amount of 20 nC/cm$^2$ by a gray scale level. The switching charge indicator Vq and the gray scale indicating voltage Vg are fed into a comparator 6 (CP), where if the switching charge indicator Vq exceeds the gray scale indicating voltage Vg, the output of the comparator becomes 1; otherwise, in the reverse case, it becomes 0. When the output of the comparator 6 becomes 1, the voltage generator 2 (VG) switches its output voltage from a select voltage (50) to a non-select voltage (52), causing the switching of the spontaneous polarization to be stopped so that a desired gray scale level can be obtained.

Figure 8:
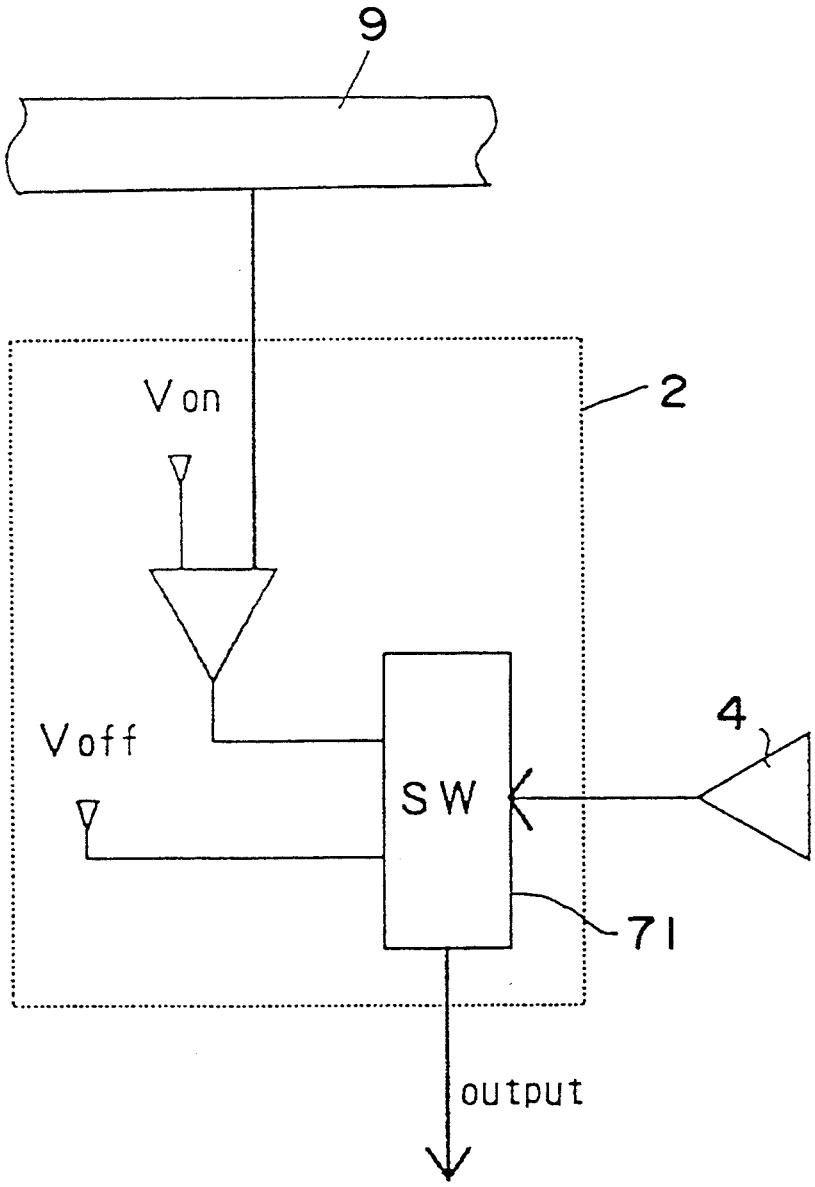
FIG. 8 is a block diagram showing a voltage generator according to the embodiment of the invention.

FIG. 8 shows a circuit arrangement of a voltage generator (VG) 2, where a switching element (SW) 71 switches between the non-select voltage $V_{off}$ and the select voltage $V_{on}$ according to the output (1 or 0) of the comparator 4 so as to be applied to the signal electrode. It is noted here that the select voltage may be converted by a voltage converter according to the gray scale indicating voltage of the video memory 9 instead of the constant voltage $V_{on}$.

Using each signal electrode driving circuit 1 (SDC) composed of the driving circuits 2 through 6, all the signal electrodes 12 are driven by the driving circuit 1.

FIG. 3 shows driving waveforms of the present invention, where numeral 21 denotes a scanning voltage to the scanning electrode 11*a*, reference numerals 22 and 23 denote voltages applied to the signal electrodes 12*a* and 12*b*, respectively, and numerals 24 and 25 voltages applied to pixels (11*a*, 12*a*) and (11*a*, 12*b*), respectively. After resetting to a black display state with a pulses during the reset period, scanning is effected two times. At the first field selection, a select voltage is applied to the signal electrode (12*a*), which is assumed to be even numbered, while a non-select voltage (V0/2) is applied to the signal electrode (12*b*), which is adjacent thereto and assumed to be odd numbered, to be regarded as the reference electrode. Then at the second field scanning, the treatment is done in the reverse arrangement, so that the select voltage is applied to the odd-numbered electrode while the pixel of the even-numbered electrode remains unchanged, thus maintaining the gray scale level of the first field scanning. In this way, desired gray scale levels can be written into all the pixels.

Although the charge up current will vary in waveform in a slight amount among sites, depending on the nonuniformity in thickness of the cell layer and depending on the concentration of ionic impurities, such influence of nonuniformity can be completely eliminated by referencing the current supplied to the adjacent electrode, which is the most significant feature of the present invention.

Figure 4:
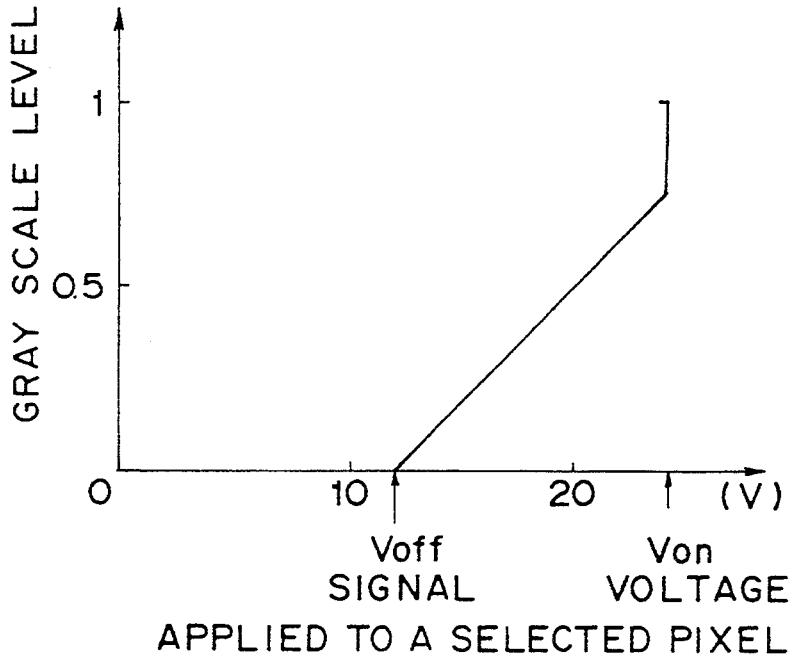
FIG. 4 is a correlation diagram between a signal voltage and a gray scale level according to the embodiment of the invention.

The voltage applied to a selected signal electrode, if changed depending on the gray scale level as shown in FIG. 4, would make it easier to unify the time required for the switching of the spontaneous polarization. However, in this case, the output voltage for the reference electrode also needs to be changed so as to become ½ of the voltage applied to the selected signal electrode. Nevertheless, for simplified circuitry, it is preferable to adopt the control by only the time for ON voltage.

Although the Ps switching charges are detected by current detection in the present embodiment, similar effects can be obtained instead by detecting the amount of Ps switching charges from voltage waveform, from the fact that the voltage waveform also involves some distortion due to the flow of switching current, as suggested by the voltage waveform 50 in FIG. 6.

Further, although the present embodiment has been described with respect to the ferroelectric liquid crystals, similar gray scale display can be realized by using the same circuit also when antiferroelectric liquid crystals are used and the phase transition between antiferroelectric and ferroelectric phases are used. However, in the case of antiferroelectric liquid crystals, the amount of switching charges that occur when the phase transition has taken place due to a voltage, will be the product of the spontaneous polarization of the liquid crystal material and the pixel area, which is equal to half that of ferroelectric liquid crystals.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A liquid crystal driving circuit for a liquid crystal panel in which ferroelectric liquid crystals are sandwiched between a plurality of scanning electrodes and a plurality of signal electrodes, which are opposed to each other, said driving circuit comprising:

a switching current detecting section for detecting, from the value of a current supplied from an arbitrary signal electrode a, a switching current value due to switching of spontaneous polarization of the ferroelectric liquid crystals at a selected pixel on the arbitrary signal electrode a;

an integrating section for integrating the switch current value to develop an integral value; and a comparator for comparing the integrated value with a gray scale indicating voltage which corresponds to gray scale data, wherein the signal voltage value applied to the arbitrary signal electrode a is changed depending on an output of said comparator, so that the gray scale indicating voltage and the integrated value are made coincident with each other.

2. The liquid crystal driving circuit as claimed in claim 1, wherein the output of the comparator is fed back to an output voltage selecting part of said driving circuit on the side of signal electrodes, whereby when the integrated value is smaller than the gray scale indicating voltage, such a level of signal voltage as to correspond to a select voltage for gray scale data is produced, and when the integrated value exceeds the gray scale signal, the signal voltage is switched to a non-select voltage.

3. The liquid crystal driving circuit as claimed in claim 2, wherein said switching current detecting section detects said switching current value due to switching of spontaneous polarization, by subtracting a current value resulting from multiplying a current supplied to a reference signal electrode regarded as a non-selected pixel in the vicinity of said selected pixel on the arbitrary signal electrode a by a constant from said current supplied from the arbitrary signal electrode a.

4. The liquid crystal driving circuit as claimed in claim 3, wherein scanning is effected two times, at a first field scanning one group of signal electrodes, which have been divided into two while the other group is assumed to be said reference signal electrode, and at a second field scanning the other is selected while the one is assumed to be said reference signal electrode.

5. The liquid crystal driving circuit as claimed in claim 3, wherein the signal voltage is a pulse voltage and the switching current detecting section includes a high frequency cut filter.

6. A display device, comprising a liquid crystal driving circuit as claimed in claim 1 and a liquid crystal panel in which ferroelectric liquid crystals are sandwiched between scanning electrodes and signal electrodes.

7. The display device as claimed in claim 6, said liquid crystal panel includes antiferroelectric liquid crystals sandwiched between the scanning electrodes and the signal electrodes.

* * * * *